US010254703B2

(12) United States Patent
Miyakoshi

(10) Patent No.: US 10,254,703 B2
(45) Date of Patent: Apr. 9, 2019

(54) CABLE FIXING MECHANISM AND IMAGE FORMING APPARATUS THEREWITH

(71) Applicant: KYOCERA Document Solutions Inc., Osaka (JP)

(72) Inventor: Naoto Miyakoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 147 days.

(21) Appl. No.: 15/422,837

(22) Filed: Feb. 2, 2017

(65) Prior Publication Data

US 2017/0242390 A1 Aug. 24, 2017

(30) Foreign Application Priority Data

Feb. 18, 2016 (JP) ..... 2016-029133

(51) Int. Cl.
*G03G 15/00* (2006.01)

(52) U.S. Cl.
CPC ..... *G03G 15/80* (2013.01); *G03G 15/605* (2013.01)

(58) Field of Classification Search
CPC ..... H05K 7/1447
USPC ..... 248/73
See application file for complete search history.

(56) References Cited

U.S. PATENT DOCUMENTS 4,325,526 A * 4/1982 Kitagawa ..... F16L 3/23 24/336
4,356,599 A * 11/1982 Larson ..... F16L 3/12 24/16 PB
6,005,195 A * 12/1999 Kam ..... H05K 7/1449 174/135
8,864,085 B2 * 10/2014 He ..... F16B 1/00 248/68.1
9,344,593 B2 * 5/2016 Shiomi ..... H04N 1/00559

FOREIGN PATENT DOCUMENTS

JP 04142968 A * 5/1992
JP 2007-139999 A 6/2007
JP 2010217381 A * 9/2010
JP 2012054458 A * 3/2012

* cited by examiner

*Primary Examiner* — Clayton E. LaBalle
*Assistant Examiner* — Leon W Rhodes, Jr.
(74) *Attorney, Agent, or Firm* — Stein IP, LLC

(57) ABSTRACT

A cable fixing mechanism has a guide member and a conductive member, and permits a flexible cable to be fixed that is formed in the shape of a strip with a plurality of conductive wires arranged parallel to one another inside a cover member. The guide member has a guide surface facing one face of the flexible cable, and is fixed to a frame made of metal. The conductive member is flexible, is fixed to the guide member to face the guide surface, and is in contact with the frame. By the restoring force of the conductive member elastically deformed when fixed to the guide member, the flexible cable is held between the conductive member and the guide surface.

11 Claims, 6 Drawing Sheets

CABLE FIXING MECHANISM AND IMAGE FORMING APPARATUS THEREWITH

INCORPORATION BY REFERENCE

This application is based upon and claims the benefit of priority from the corresponding Japanese Patent Application No. 2016-029133 filed on Feb. 18, 2016, the entire contents of which are incorporated herein by reference.

BACKGROUND

The present disclosure relates to a flexible cable fixing mechanism used for wiring in an electronic device, such as an image forming apparatus, that is provided with a plurality of electronic components.

In an electronic device such as an image forming apparatus, various types of electronic components are arranged inside the device. To electrically connect those electronic components together, a wiring cable is commonly used that is provided with connectors which are arranged in opposite end parts of the wiring cable for being coupled to connectors for connection provided in the electronic components.

In particular, a flexible cable (flexible flat cable, FFC) formed in the shape of a strip with a plurality of conductive wires arranged parallel to one another inside a cover member is widely used as a wiring cable in electronic devices because the flexible cable is excellent in flexibility and bendable into an arbitrary shape, and thereby a space for wiring can be reduced. On the other hand, the flexible cable is formed flat in the shape of a strip, and this may inconveniently cause breakage as compared with a typical wiring cable.

As a solution, various fixing mechanisms have been proposed that prevent breakage of a flexible cable, for example, a flat cable protection device is known in which a protection member wider than a flat cable (flexible cable) is fixed so as to protrude beyond an end surface of the flat cable and a cut is provided in the protection member for fitting a clamp for harness.

SUMMARY

According to one aspect of the present disclosure, a cable fixing mechanism includes a guide member and a conductive member, and is a fixing mechanism for a flexible cable which is formed in the shape of a strip with a plurality of conductive wires arranged parallel to one another inside a cover member. The guide member has a guide surface facing one face of the flexible cable, and is fixed to a frame made of metal. The conductive member is flexible, is fixed to the guide member so as to face the guide surface, and is in contact with the frame. By the restoring force of the conductive member which is elastically deformed when fixed to the guide member, the flexible cable is held between the conductive member and the guide surface.

Further features and advantages of the present disclosure will become apparent from the description of embodiments given below.

DETAILED DESCRIPTION

Figure 1:
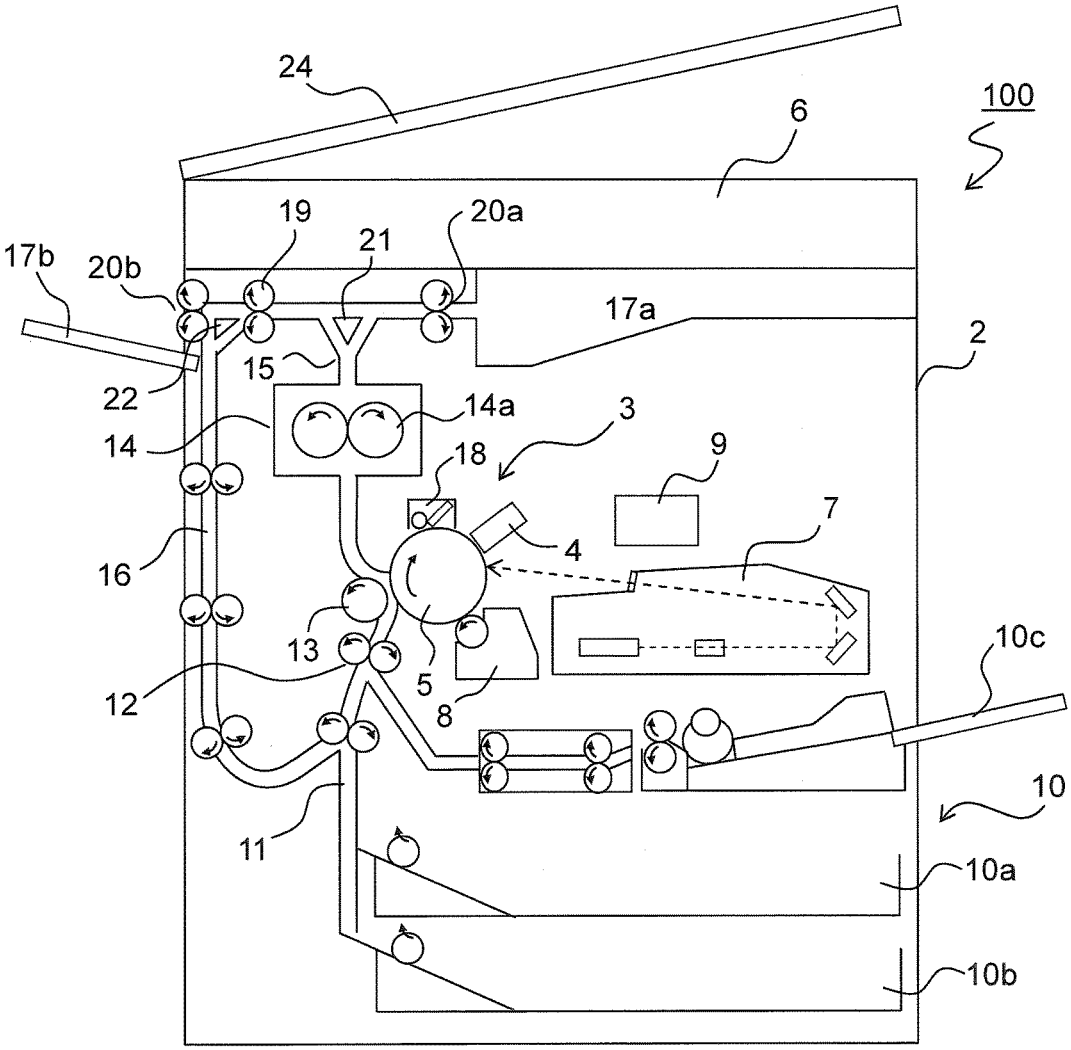
FIG. 1 is a schematic diagram showing an overall construction of an image forming apparatus incorporating an image reading device provided with a cable fixing mechanism according to the present disclosure.

Hereinafter, embodiments of the present disclosure will be described with reference to the accompanying drawings. FIG. 1 is a schematic sectional view showing an internal structure of an image forming apparatus 100 incorporating an image reading device 6 provided with a cable fixing mechanism 80 according to the present disclosure. In the image forming apparatus 100 shown in FIG. 1 (here a digital multifunction peripheral is taken as an example), a copy operation proceeds as follows. In the image reading device 6, document image data is read and converted into an image signal. On the other hand, in an image forming portion 3 inside a multifunction peripheral main body 2, a photosensitive drum 5 that rotates in the clockwise direction in FIG. 1 is electrostatically charged uniformly by a charging unit 4. Then, by a laser beam from an exposure unit (such as a laser scanner unit) 7, an electrostatic latent image is formed on the photosensitive drum 5 based on the document image data read in the image reading device 6. Then, developer (hereinafter, referred to as toner) is attached to the electrostatic latent image by a developing unit 8, thereby forming a toner image. Toner is fed to the developing unit 8 from a toner container 9.

Toward the photosensitive drum 5 having the toner image formed on it as described above, a sheet is transported from a sheet feeding mechanism 10 via a sheet transport passage 11 and a registration roller pair 12 to the image forming portion 3. In the image forming portion 3, the toner image formed on the surface of the photosensitive drum 5 is transferred to the sheet by a transfer roller 13 (image transfer portion). Then, the sheet having the toner image transferred to it is separated from the photosensitive drum 5, and is transported to a fixing portion 14, where the toner image is fixed to the sheet. The fixing portion 14 has a fixing roller pair 14*a*. The sheet having passed through the fixing portion 14 is transported to a sheet transport passage 15 which branches into a plurality of directions, and is distributed among different transport directions by passage switching mechanisms 21 and 22 which have a plurality of passage switching guides arranged at branch points in the sheet transport passage 15. The sheet is then, as it is (or after being transported to a reverse transport passage 16 and being subjected to two-sided copying), discharged via a discharge roller pair 20*a* or a discharge roller pair 20*b* onto a sheet discharge portion including a first discharge tray 17*a* and a second discharge tray 17*b*.

On the downstream side of a cleaning device 18 in the rotation direction of the photosensitive drum 5, a destaticizer (unillustrated) is arranged which removes electric charge remaining on the surface of the photosensitive drum 5. The sheet feeding mechanism 10 includes a plurality of sheet feed cassettes 10*a* and 10*b* mountably/dismountably fitted to the multifunction peripheral main body 2 for storing sheets and a stack bypass (manual tray) 10*c* arranged above them; these are connected, via the sheet transport passage 11, to the image forming portion 3 which includes the photosensitive drum 5, the developing unit 8, and the like. At an end of the image reading device 6, a platen (document presser) 24 is openably/closably arranged which presses and thereby holds a document placed on a contact glass 25 (see FIG. 2).

Figure 2:
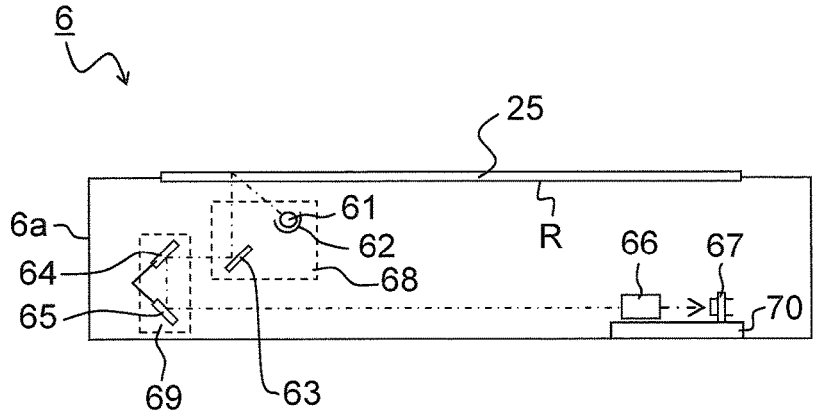
FIG. 2 is a side sectional view of the image reading device.

Now, a description will be given of a structure of the image reading device 6 for reading a document image as an electrical signal. FIG. 2 is a side sectional view showing an internal structure of the image reading device 6 according to the embodiment. In a frame 6*a* of the image reading device 6, there are arranged a lamp (light source) 61 which radiates light toward the image side of a document, a reflection plate 62 for efficiently shining light from the lamp 61 on the image side of the document, a first mirror 63 which directly receives the light reflected from the document and then reflects it, a second mirror 64 which receives the light reflected from the first mirror 63 and then reflects it, and a third mirror 65 which receives the light reflected from the second mirror 64 and then reflects it.

On a base plate 70, there are arranged a lens barrel 66 that holds a lens group (unillustrated) into which the light reflected from the third mirror 65 is directed to be converged, and a line CCD (charge-coupled device) sensor 67 provided with a charge-coupled device that receives the document-reflected light converged through the lens group in the lens barrel 66 and converts it into an electrical signal. Here, the optical path of the document-reflected light is indicated by a dash-dot line.

Here, the lamp 61, the reflection plate 62, and the first mirror 63 are fixed together to a first carriage 68. The second mirror 64 and the third mirror 65 are fixed together to a second carriage 69. These first and second carriages 68 and 69 constitute a scanning means, and can independently reciprocate in coordination with each other.

When an image of a document placed on the contact glass 25 is read, the first and second carriages 68 and 69 reciprocate (move for scanning), while mutually keeping the optical path length of the document-reflected light constant, under an image reading region R of the contact glass 25. The first and second carriages 68 and 69 are driven by an unillustrated carriage driving motor.

In such a configuration, the document-reflected light emitted from the lamp 61 and then reflected on the image side of a document is reflected on the first to third mirrors 63 to 65, enters the lens group in the lens barrel 66, and is converged through the lens group to be imaged on the CCD sensor 67. Then, photoelectric conversion is performed in the CCD sensor 67; the imaged document-reflected light is resolved into pixels, and is converted into an electrical signal according to the density of the individual pixels. In this way, an image is read.

Figure 3:
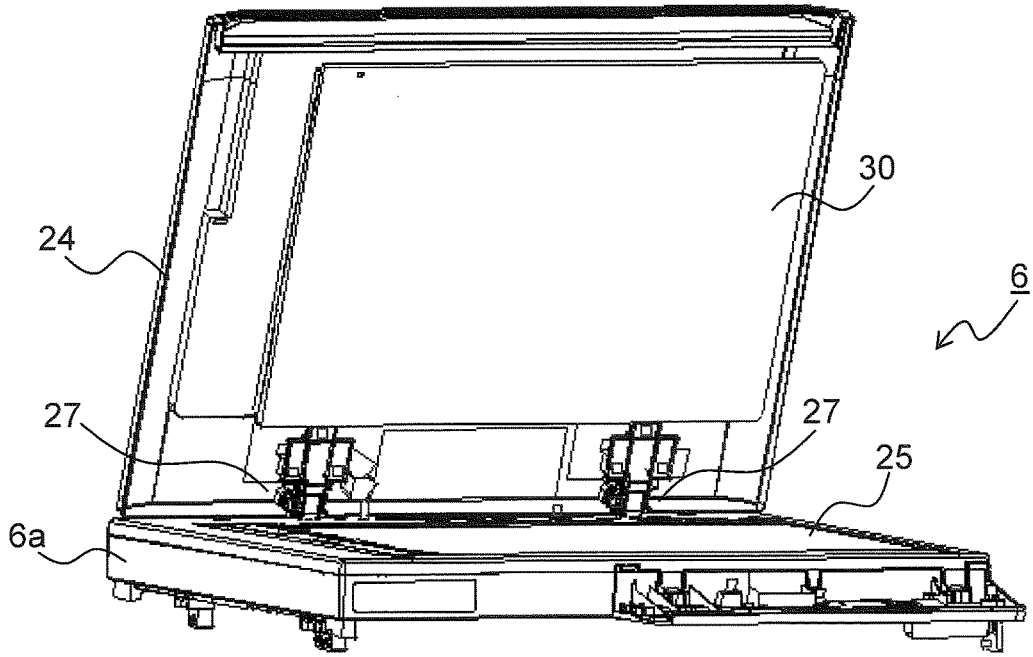
FIG. 3 is an exterior perspective view of the image reading device as seen from in front, showing a state with a platen open.
Figure 4:
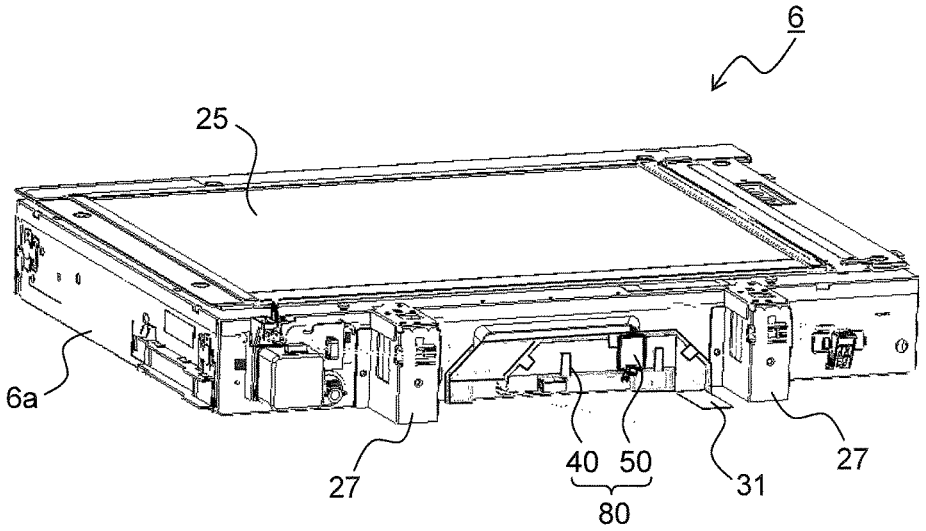
FIG. 4 is an exterior perspective view of the image reading device as seen from behind.

FIGS. 3 and 4 are exterior perspective views of the image reading device 6 as seen from in front and from behind respectively. FIG. 3 shows a state with a platen 24 open, and FIG. 4 shows a state with the platen 24 removed. The image reading device 6 includes a contact glass 25 arranged on a top surface of the frame 6*a* (document placement stage), and the platen 24 which presses and thereby holds a document placed on the contact glass 25. The platen 24 is supported, so as to be openable/closable in the up/down direction, on a pair of hinges 27 arranged at two places in an end part of the top surface of the frame 6*a*. On the reverse face of the platen 24, a white mat 30 (document pressing portion) is arranged which directly presses a document.

To the rear side of the frame 6*a*, a guide member 40 and a conductive member 50 are fitted between the pair of hinges 27. The guide member 40 permits a flexible cable 31 which electrically connects together a control circuit board (unillustrated) of the image forming apparatus 100 main body and the image reading device 6 to be wired in a bent state along the frame 6*a*. The conductive member 50 is mountably/dismountably fitted to the guide member 40, holds the flexible cable 31 between the conductive member 50 and the guide member 40, and lies in contact with the frame 6*a*. The guide member 40 and the conductive member 50 constitute the cable fixing mechanism 80 which fixes the flexible cable 31 to the frame 6*a*.

Figure 5:
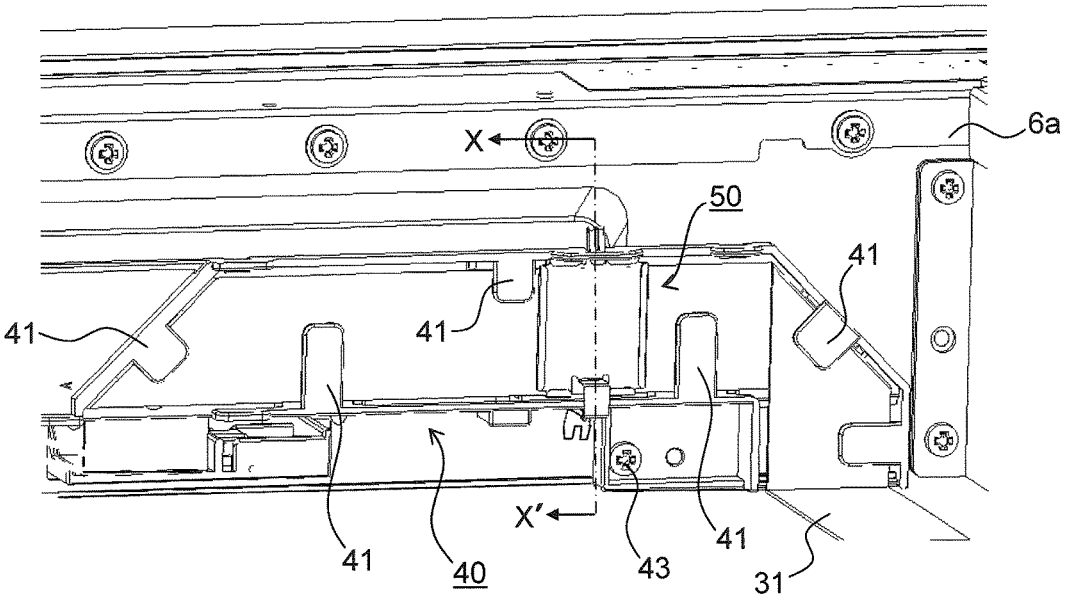
FIG. 5 is a partly enlarged view around the guide member in FIG. 4.
Figure 6:
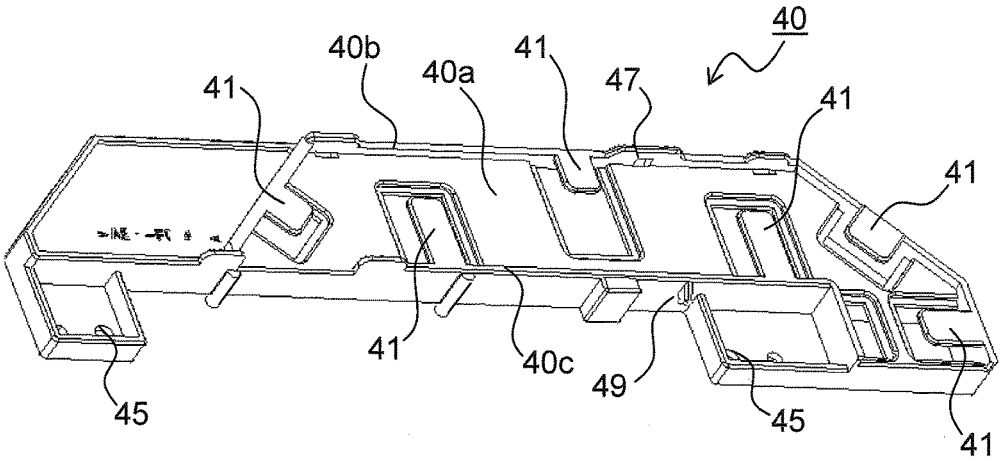
FIG. 6 is a perspective view of the guide member included in the cable fixing mechanism according to the present disclosure.

FIG. 5 is a partly enlarged view around the guide member 40 in FIG. 4. FIG. 6 is a perspective view of the guide member 40. The guide member 40 is made of resin, and has a guide surface 40*a* with which one face (reverse face) of the flexible cable 31 lies in contact and side walls 40*b* and 40*c* facing, across the guide surface 40*a*, side edges of the flexible cable 31 in its width direction. A plurality of guide ribs 41 are formed protruding from the side walls 40*b* and 40*c* so as to overlap the guide surface 40*a*. In a lower part of the guide member 40, screw holes 45 are formed respectively at left and right places for fixing the guide member 40 to the frame 6*a* with screws 43 (see FIG. 5).

In the side wall 40*b*, an engaging hole 47 is formed, and on the side wall 40*c*, an engaging protrusion 49 is formed at a position opposite from the engaging hole 47. The engaging hole 47 penetrates the side wall 40*b*, and the engaging protrusion 49 protrudes outward (toward the side opposite from the guide surface 40*a*) from the side wall 40*c*.

Figure 7:
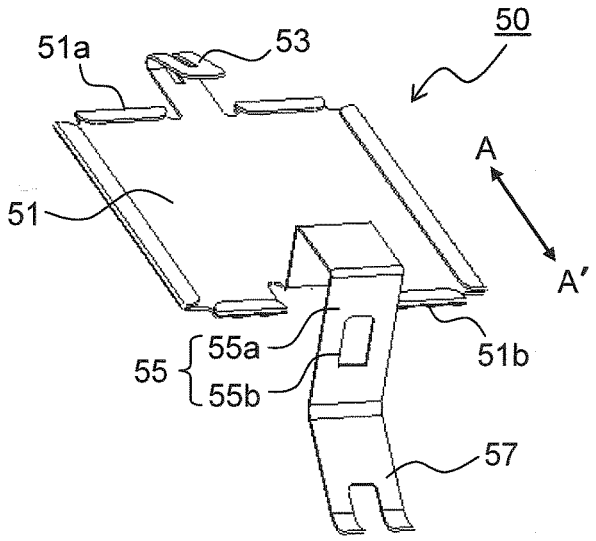
FIG. 7 is a perspective view of a conductive member included in the cable fixing mechanism according to a first embodiment of the present disclosure.

FIG. 7 is a perspective view of the conductive member 50 included in the cable fixing mechanism 80 according to a first embodiment of the present disclosure. The conductive member 50 is formed by bending a metal sheet, and has a rectangular pressing portion 51 with which the other face (obverse face) of the flexible cable 31 lies in contact, and a first engaging portion 53 and a second engaging portion 55 respectively protruding from opposite edges 51*a* and 51*b* of the pressing portion 51 in the width direction of the flexible cable 31 (in the direction indicated by arrows A and A' in FIG. 7).

The pressing portion 51 is arranged opposite the guide surface 40*a* of the guide member 40, and the flexible cable 31 is held between the guide surface 40*a* and the pressing portion 51. To increase the rigidity of the pressing portion 51, four side edges of the pressing portion 51 are folded back on the opposite side (the top face side in FIG. 7) of the pressing portion 51 from the face facing the guide surface 40*a*.

The first engaging portion 53 has a tip end part bent into a shape with a V-shaped section toward the opposite side (the top face side in FIG. 7) from the face facing the guide surface 40*a*. The first engaging portion 53 is inserted, starting with the V-shaped bent part, into the engaging hole 47 (see FIG. 6), and is thereby fixed to the side wall 40*b*.

The second engaging portion 55 has a bent portion 55*a* bent into a shape with a U-shaped section toward the opposite side (the top face side in FIG. 7) from the face facing the guide surface 40*a*, and an opening 55*b* formed in the surface of the bent portion 55*a* facing the edge 51*b*. The second engaging portion 55 is fixed to the side wall 40*c* as a result of the opening 55*b* being engaged with the engaging protrusion 49 (see FIG. 5). At a tip end of the bent portion 55*a*, a conductive piece 57 is continuously formed which bends toward the side (the bottom face side in FIG. 7) facing the guide surface 40*a*.

Now, a description will be given of a method for fixing the flexible cable 31 by use of the cable fixing mechanism 80 according to the first embodiment. First, one end of the flexible cable 31 is connected to a connector (unillustrated) of the image reading device 6. Then, the flexible cable 31 is bent along the guide surface 40*a* of the guide member 40, which is fixed to the frame 6*a*, to be inserted into a gap between the guide surface 40*a* and the guide rib 41. In this way, the flexible cable 31 is temporarily held on the guide member 40.

Then, the first engaging portion 53 of the conductive member 50 is inserted into the engaging hole 47 of the guide member 40, and the opening 55*b* of the second engaging portion 55 is hooked on the engaging protrusion 49 of the guide member 40. In this way, the flexible cable 31 is held between the guide surface 40*a* and the pressing portion 51. Then, the other end of the flexible cable 31 is connected to the control circuit board (unillustrated) of the image forming apparatus 100 main body, and now the connection between the image reading device 6 and the image forming apparatus 100 main body is complete.

Figure 8:
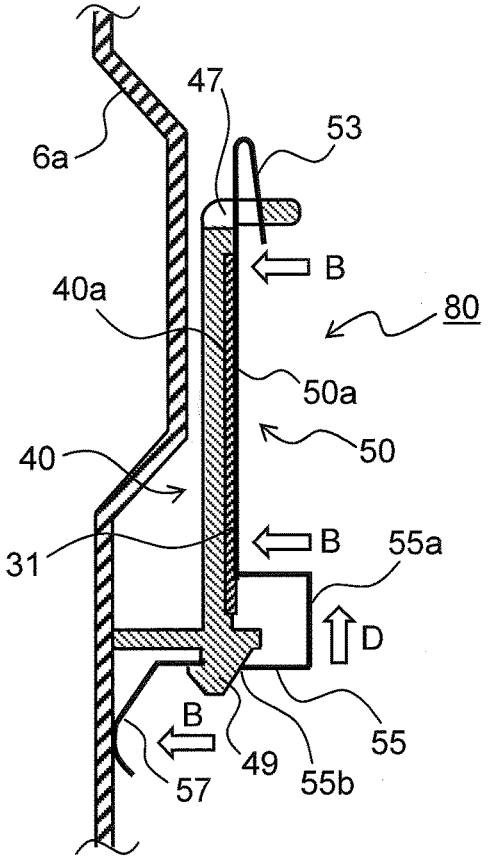
FIG. 8 is a sectional view of a flexible cable as cut in the width direction, which is fixed by use of the cable fixing mechanism according to the first embodiment.

FIG. 8 is a sectional view (as seen from the direction indicated by arrows X and X' in FIG. 5) of the flexible cable 31 as cut in the width direction, which is fixed by use of the cable fixing mechanism 80 according to the first embodiment. As shown in FIG. 8, the first engaging portion 53 of the conductive member 50 inserted into the engaging portion 47 is elastically deformed in a direction in which its V-shape is compressed (in the left/right direction in FIG. 8). On the other hand, when the opening 55*b* of the second engaging portion 55 is engaged with the engaging protrusion 49, a gap between the edge 51*b* of the pressing portion 51 and the guide surface 40*a* is configured to be smaller than the thickness of the flexible cable 31. Thus, when the flexible cable 31 is held between the pressing portion 51 and the guide surface 40*a*, the second engaging portion 55 (bent portion 55*a*) is elastically deformed in a direction away from the guide surface 40*a*.

As a result, due to the restoring force of the first and second engaging portions 53 and 55, a force acts on the pressing portion 51 in a direction (the direction indicated by arrow B) approaching the guide surface 40*a*. This makes it possible to stably keep the contact state between the flexible cable 31 and the conductive member 50.

Figure 9:
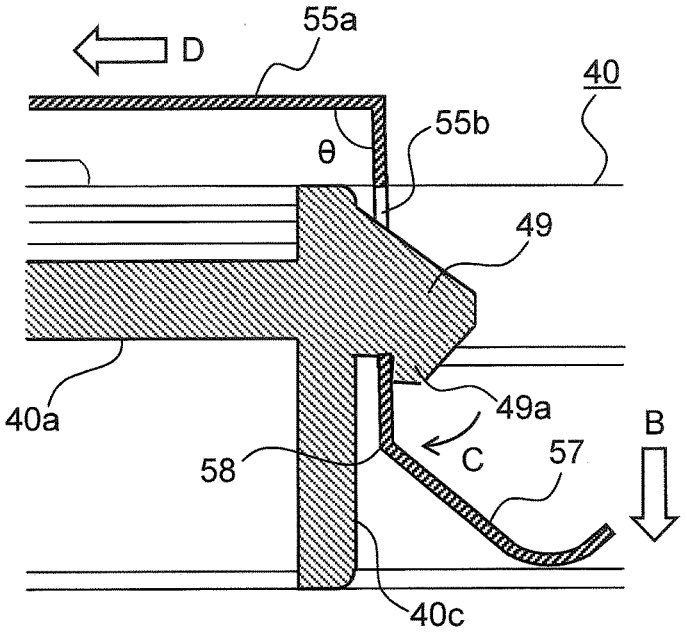
FIG. 9 is an enlarged sectional view of an engagement part between an engaging protrusion and a second engaging portion in FIG. 8.

FIG. 9 is an enlarged sectional view of an engagement part between the engaging protrusion 49 and the second engaging portion 55 in FIG. 8. As shown in FIG. 9, on the bottom end surface of the engaging protrusion 49, a hook 49*a* is formed protruding downward. While the second engaging portion 55 is elastically deformed in a direction (the direction indicated by arrow C) in which the bending angle θ of the U-shaped bent portion 55*a* becomes acute, the opening 55*b* is hooked on the hook 49*a* of the engaging protrusion 49. Thus, due to the restoring force of the bent portion 55*a* that tends to cancel the elastic deformation, a force that biases the conductive member 50 upward (in the direction indicated by arrow D) acts on the engagement part between the engaging protrusion 49 and the second engaging portion 55.

That is, the conductive member 50 is biased in a direction (the direction indicated by arrow D) in which the first engaging portion 53 is inserted into the engaging hole 47; this helps prevent the first engaging portion 53 from falling out of the engaging hole 47, eliminating the danger of the conductive member 50 falling off the guide member 40.

The conductive member 50 is, as a result of the opening 55*b* being engaged with the engaging protrusion 49, elastically deformed in a direction in which a coupling portion 58 between the second engaging portion 55 and the conductive piece 57 is bent, and thus due to the restoring force of the coupling portion 58, a force acts on the conductive piece 57 in a direction (the direction indicated by arrow B) in which it is pressed against the frame 6*a*. This makes it possible to stably keep the contact state (conductive state) between the conductive member 50 and the frame 6*a*. As a result of the conductive member 50 being in contact with the frame 6*a*, the flexible cable 31 is grounded via the frame 6*a* to a ground.

In the configuration according to the embodiment, the flexible cable 31 is grounded to a ground via the conductive member 50 and the frame 6*a*, and thus it is possible to offer an image forming apparatus 100 that reduces occurrence of electromagnetic wave noise from the flexible cable 31 and leakage of electromagnetic wave noise to the outside and that has no influence on other electronic devices around it.

The flexible cable 31 is held firmly between the guide member 40 and the conductive member 50 by the restoring force of the conductive member 50, and thus it is possible to stabilize the position of the flexible cable 31 and thus to suppress occurrence of electromagnetic wave noise more effectively.

In particular, in the image reading device 6, a charge-coupled device is arranged that is a main source of electromagnetic wave noise, and thus using the cable fixing mechanism 80 according to the embodiment when the image reading device 6 is connected to the control circuit board or to another electronic component helps reduce electromagnetic wave noise more effectively.

When the conductive member 50 is fastened with a screw, the conductive member 50 may warp when the screw is tightened; this may inconveniently cause failure to make contact with the flexible cable 31. In this respect, in this embodiment, there is no need to fasten the conductive member 50 to the guide member 40 with a screw or the like, and thus it is possible to suppress occurrence of contact failure between the flexible cable 31 and the conductive member 50. It is also possible to simplify the fixing operation of the flexible cable 31, and thus to improve assembly efficiency.

Figure 10:
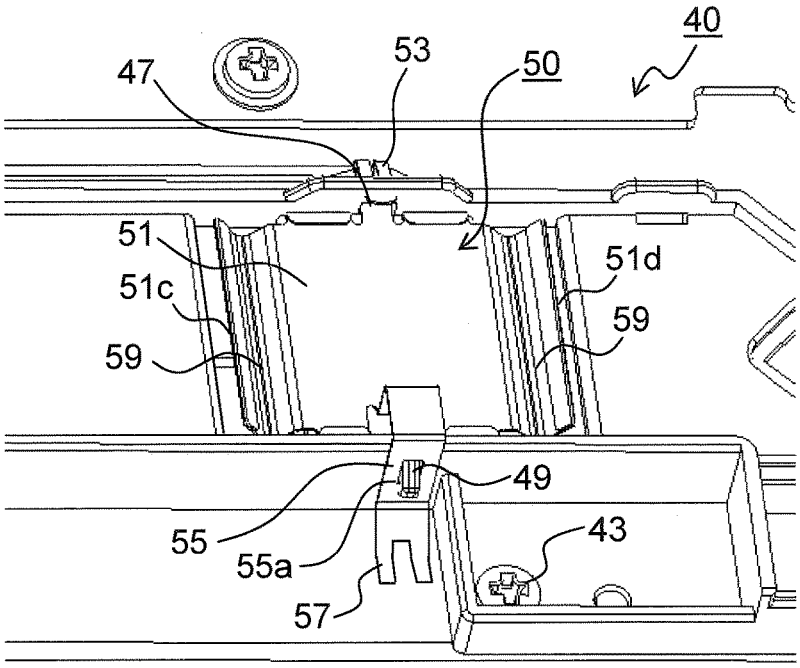
FIG. 10 is a perspective view showing a state where a conductive member included in a cable fixing mechanism according to a second embodiment of the present disclosure is fitted to a guide member.
Figure 11:
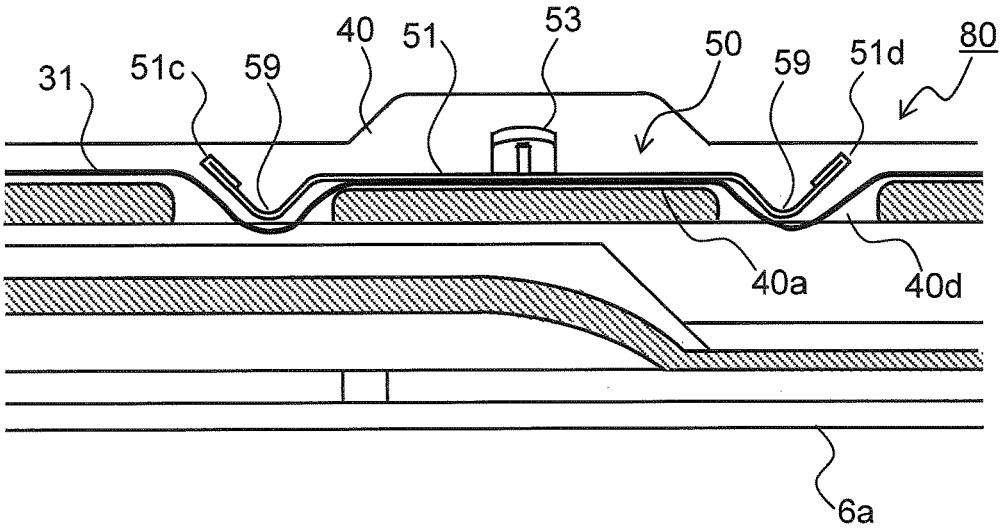
FIG. 11 is a sectional view of the flexible cable as cut in the longitudinal direction, which is fixed by use of the cable fixing mechanism according to the second embodiment.

FIG. 10 is a perspective view showing a state where a conductive member 50 included in a cable fixing mechanism 80 according to a second embodiment of the present disclosure is fitted to a guide member 40. FIG. 11 is a sectional view of the flexible cable 31 as cut in the longitudinal direction, which is fixed by use of the cable fixing mechanism 80 according to the second embodiment. The conductive member 50 included in the cable fixing mechanism 80 according to the embodiment has curved portions 59, which are convex toward the guide surface 40*a*, formed along the edges 51*c* and 51*d* of the pressing portion 51 in its longitudinal direction. The guide member 40 has concavities 40*d* formed at positions facing the curved portions 59 in the guide surface 40*a*. The structures of the guide member 40 and the conductive member 50 in other respects are similar to those in the first embodiment, and thus no overlapping description will be repeated.

In the configuration according to the embodiment, the flexible cable 31 is held, in a state curved like waves, between the curved portions 59 of the conductive member 50 and the concavities 40*d* of the guide member 40. Thus, the movement of the flexible cable 31 in the extension direction (the left/right direction in FIG. 11) is restricted to reliably position the flexible cable 31, and thereby it is possible to hold the flexible cable 31 more stably and thus to suppress occurrence of electromagnetic wave noise more effectively.

The embodiments described above are in no way meant to limit the present disclosure, which thus allows for many modifications and variations within the spirit of the present disclosure. For example, although in the above-described embodiments, the cable fixing mechanism 80 according to the present disclosure is used for fixing a flexible cable 31 that connects together the image reading device 6 and the control circuit board of the image forming apparatus 100, this is not meant as any limitation; the cable fixing mechanism 80 can be used for fixing a flexible cable that connects together any other device in the image forming apparatus 100 and the control circuit board, such as the exposure unit 7, the developing unit 8, or the fixing portion 14.

The cable fixing mechanism 80 according to the present disclosure is applicable not only to digital multifunction peripherals like the one shown in FIG. 1 but also to other types of image forming apparatuses such as analog and digital monochrome copiers, color copiers, color printers, and facsimile machines. Needless to say, the cable fixing mechanism 80 is applicable also to flexible cable fixing mechanisms of electronic devices other than image forming apparatuses.

The present disclosure is applicable to a flexible cable fixing mechanism used for wiring in an electronic device, such as an image forming apparatus, that is provided with a plurality of electronic components. Based on the present disclosure, by reliably puffing a flexible cable and a conductive member in contact with each other, it is possible to provide a cable fixing mechanism that can effectively reduce electromagnetic wave noise.

What is claimed is:

1. A cable fixing mechanism comprising:

a guide member having a guide surface facing one face of a flexible cable which is formed in a shape of a strip with a plurality of conductive wires arranged parallel to one another inside a cover member, the guide member being fixed to a frame made of metal; and a conductive member that is flexible, the conductive member being fixed to the guide member so as to face the guide surface and being in contact with the frame, wherein by a restoring force of the conducive member which is elastically deformed when fixed to the guide member, the flexible cable is held between the conductive member and the guide surface, the conductive member has:

a pressing portion in contact with substantially an entire area of the flexible cable in a width direction thereof; and a first engaging portion and a second engaging portion respectively protruding from opposite edges of the pressing portion in the width direction of the flexible cable, the first and second engaging portions engaging with the guide member, and as a result of at least one of the first and second engaging portions being elastically deformed, a restoring force acts on the pressing portion in a direction approaching the guide surface, and the first engaging portion has a tip end part thereof bent to have an acute angle toward a side opposite from the guide surface, and is inserted, starting with the bent part, into an engaging hole formed in the guide member.

2. The cable fixing mechanism of claim 1, wherein the second engaging portion has:

a bent portion bent into a shape with a U-shaped section to be convex toward the side opposite from the guide surface; and an opening formed in a surface of the bent portion facing an edge of the pressing portion, the opening being engaged with an engaging protrusion formed on the guide member.

3. The cable fixing mechanism of claim 2, wherein on the engaging protrusion, a hook is formed protruding downward, and as a result of the opening being hooked on the hook while the bent portion is elastically deformed in a direction in which a bent angle of the bent portion becomes acute, a restoring force acts on the conductive member in a direction in which the first engaging portion is inserted into the engaging hole.

4. The cable fixing mechanism of claim 1, wherein the guide member has a pair of side walls facing, across the guide surface, side edges of the flexible cable in a width direction thereof, and has a plurality of guide ribs formed protruding from the side walls so as to overlap the guide surface.

5. An image forming apparatus comprising:

An image forming portion for forming a toner image; and the cable fixing mechanism of claim 1.

6. A cable fixing mechanism comprising:

a guide member having a guide surface facing one face of a flexible cable which is formed in a shape of a strip with a plurality of conductive wires arranged parallel to one another inside a cover member, the guide member being fixed to a frame made of metal; and a conductive member that is flexible, the conductive member being fixed to the guide member so as to face the guide surface and being in contact with the frame, wherein by a restoring force of the conducive member which is elastically deformed when fixed to the guide member, the flexible cable is held between the conductive member and the guide surface, the conductive member has:

a pressing portion in contact with substantially an entire area of the flexible cable in a width direction thereof; and a first engaging portion and a second engaging portion respectively protruding from opposite edges of the pressing portion in the width direction of the flexible cable, the first and second engaging portions engaging with the guide member, and as a result of at least one of the first and second engaging portions being elastically deformed, a restoring force acts on the pressing portion in a direction approaching the guide surface, and at a tip end of the second engaging portion, a conductive piece is continuously formed which is put in pressed contact with the frame by elastic deformation when the conductive member is fixed to the guide member.

7. The cable fixing mechanism of claim 6, wherein the guide member has a pair of side walls facing, across the guide surface, side edges of the flexible cable in a width direction thereof, and has a plurality of guide ribs formed protruding from the side walls so as to overlap the guide surface.

8. An image forming apparatus comprising the cable fixing mechanism of claim 6.

9. A cable fixing mechanism comprising:

a guide member having a guide surface facing one face of a flexible cable which is formed in a shape of a strip with a plurality of conductive wires arranged parallel to one another inside a cover member, the guide member being fixed to a frame made of metal; and a conductive member that is flexible, the conductive member being fixed to the guide member so as to face the guide surface and being in contact with the frame, wherein by a restoring force of the conducive member which is elastically deformed when fixed to the guide member, the flexible cable is held between the conductive member and the guide surface, the conductive member has a curved portion, which is convex toward the guide surface, formed to extend along the flexible cable in a width direction thereof, and in the guide surface, a concavity is formed at a position facing the curved portion along the flexible cable in the width direction thereof.

10. The cable fixing mechanism of claim 9, wherein the guide member has a pair of side walls facing, across the guide surface, side edges of the flexible cable in a width direction thereof, and has a plurality of guide ribs formed protruding from the side walls so as to overlap the guide surface.

11. An image forming apparatus comprising the cable fixing mechanism of claim 9.

* * * * *